United States Patent [19]

Watson

[11] Patent Number: 4,989,267

[45] Date of Patent: Feb. 5, 1991

[54] WEIGHTED TRAINING VEST FOR ATHLETIC ACTIVITIES

[75] Inventor: Douglas E. Watson, No. 6, 3665 SE. Monroe St., Milwaukie, Oreg. 97222

[73] Assignees: Douglas E. Watson; Forrest Bennett, both of Gladstone, Oreg.

[21] Appl. No.: 456,456

[22] Filed: Dec. 26, 1989

[51] Int. Cl.[5] ..... A41D 1/04; A63B 21/12

[52] U.S. Cl. ..... 2/102; 2/2.5; 272/119

[58] Field of Search ..... 2/2, 2.5, 69, 102, 247, 2/249, 250, 251, DIG. 6, DIG. 1; 272/119

[56] References Cited

U.S. PATENT DOCUMENTS

| | | | |
|---|---|---|---|
| 3,761,962 | 10/1973 | Myers | 2/DIG. 1 |
| 3,793,648 | 2/1974 | Dorre | 2/2.5 |
| 4,268,917 | 5/1981 | Massey | 272/119 |
| 4,382,302 | 5/1983 | Watson | 272/119 |
| 4,407,497 | 10/1983 | Gracie | 272/119 |
| 4,602,387 | 7/1986 | Zakrzewski | 272/119 |
| 4,658,442 | 4/1987 | Tomlinson | 272/119 |

FOREIGN PATENT DOCUMENTS

| | | | |
|---|---|---|---|
| 2146265 | 3/1973 | Fed. Rep. of Germany | 2/2.5 |
| 3532512 | 3/1987 | Fed. Rep. of Germany | 272/119 |
| 5960 | of 1903 | United Kingdom | 272/119 |
| 23746 | of 1914 | United Kingdom | 2/2.5 |

*Primary Examiner*—Werner H. Schroeder
*Assistant Examiner*—Diana L. Biefeld
*Attorney, Agent, or Firm*—Chernoff, Vilhauer, McClung & Stenzel

[57] ABSTRACT

A weighted training vest device includes front and rear interconnected panels and made of a bendable resilient material. The front and rear panels include pocket-like recesses which selectively receive weights according to the desires of the user. The recesses include pressure sensitive fastening material which cooperatively mates with similar material affixed to the weights. The weights are rounded and beveled with no sharp corners or edges so that the surface of the panels of the vest is generally smooth.

14 Claims, 3 Drawing Sheets

WEIGHTED TRAINING VEST FOR ATHLETIC ACTIVITIES

BACKGROUND OF THE INVENTION

This invention relates to a training device for athletic use and more particularly to a weighted training vest which may be worn by athletes while performing a wide variety of athletic activities.

The benefits of training for an athletic activity while using a weighted training vest are well known, as described in U.S. Pat. No. 4,382,302 issued May 10, 1983. That patent describes a weighted training vest in which weights are affixed to rigid front and rear panels forming the vest in a pattern adapted primarily for strengthening the wearer's leg and thigh muscles by providing increased resistance while the wearer is running. Running, however, is a solitary activity and does not involve potential body contact with other athletes nor is there much bending or twisting, especially of the upper body where the vest is worn.

A number of athletic activities such as basketball, tennis, or volleyball involve either considerable bending and twisting of the upper torso, or may involve close body proximity or even contact. In training for such sports, a desirable tool would be the use of a weighted training vest such as that described in the aforementioned U.S. Pat. No. 4,382,302. However, for these particular sports and other sports like them, such a training vest is inadequate because the weights can be easily knocked off if there is bodily contact or the placement of the weights may make certain upper torso movements difficult or impractical due to the fact that the weights protrude outwardly of the surface of the vest and have sharp edges and corners. Another problem with the aforementioned training vest is that many of the weights are placed too high on the upper body; that is, they are placed in the region of the chest and shoulders which can affect the athlete's balance due to the position of these weights relative to the body's center of mass. Thus, it would be desirable to have a weighted training vest which could be worn by athletes training for a wide range of athletic activities, even those involving bending and twisting of the upper body as well as close body proximity or even bodily contact without interfering with the athlete's movements and without the weights becoming knocked off the vest or otherwise creating an injury hazard.

SUMMARY OF THE PRESENT INVENTION

The aforementioned problems are solved by the present invention which is an athletic training vest device adapted to be worn upon the athlete's person while engaged in a variety of athletic activities, and includes front and rear flexible panels adapted to fit against the wearer's back and chest wherein the panels include a plurality of recessed areas forming pockets which are adapted to receive a plurality of weights respectively, each of the weights having a shape compatible to fit inside one of the pockets. The pockets include a fastening material which cooperatively mates with fasteners on each of the weights. Since the weights are held in recesses in the front and rear panels, they do not protrude from the panels so as to interfere with the wearer's movement nor will the weights become knocked off because of bodily contact or limb movement.

The weights have generally rounded edges and corners so that even with the protrusions of portions of the weights from the pockets in the front and rear panels, the surface of the training vest is generally smooth. To this end, the weights may be covered with a plastic or rubber material such as PVC so that there will be no exposed sharp edges or corners.

The weights are arranged in a generally symmetrical horizontal pattern on each of the panels and most of the pockets for the weights are arranged in two symmetric rows near the bottom of each panel adjacent the wearer's midsection. This provides the capability of placing the bulk of the weight close to the wearer's center of mass so that the advantages of resistance training may be realized without the negative effect of placing weights higher up on the chest and back where they might interfere with the athlete's balance. The two symmetric rows of pockets may be bisected by a recess to receive a belt for holding the panels snugly against the wearer's torso. This allows a snug fit near the waistline and hip area while at the same time allowing the chest and back to expand and contract without interference from the vest. The front and rear panels include an interconnecting piece which will extend across the shoulders. The entire vest, including the interconnecting pieces, may be formed from a single sheet of low density copolymer material. The material may include vent holes in the chest and back regions which allow the skin to breathe.

It is a principal object of this invention to provide an athletic training vest device which will enable an athlete to train comfortably for a wide variety of athletic activities.

Yet a further object of this invention is to provide an athletic training vest device having selectively removable weights which can be worn while engaged in a variety of athletic activities without the problem of interference from the weights.

A still further object of this invention is to provide an athletic training vest device having selectively removable weights in which most the weight may be held snugly against the wearer's midsection while allowing flexibility in the upper body area.

A still further object of this invention is to provide a weighted training vest with selectively removable weights wherein the weights are held in the vest by fastening material located in pocket-like recesses so that the weights do not protrude forwardly of the vest in such a way as to interfere with the athlete's movements.

The foregoing and other objectives, features, and advantages of the invention will be more readily understood upon consideration of the following detailed description of the invention, taken in conjunction with the accompanying drawings.

DETAILED DESCRIPTION OF THE INVENTION

Figure 1:
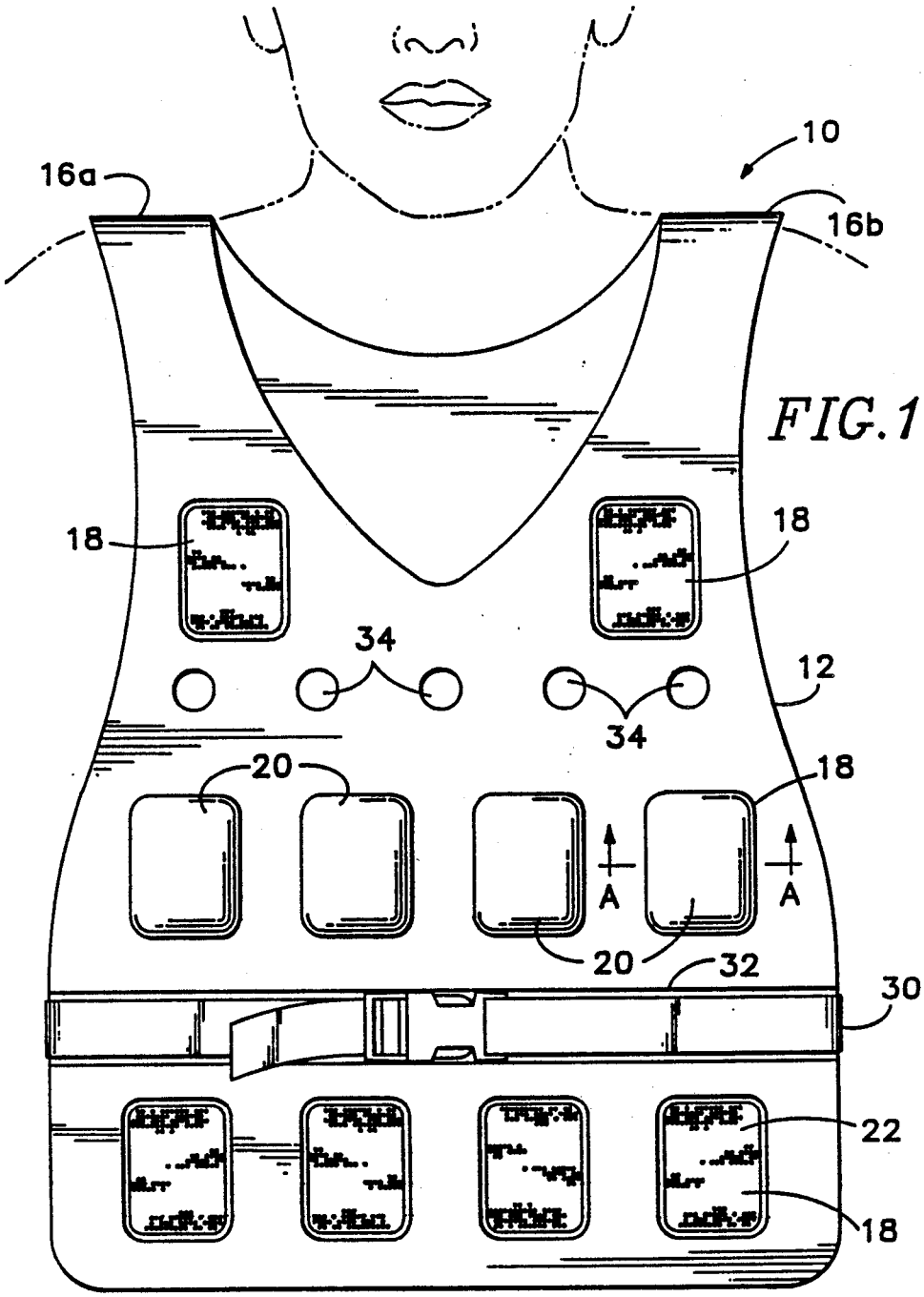
FIG. 1 is a front view of an athletic training vest device constructed according to the present invention.
Figure 2:
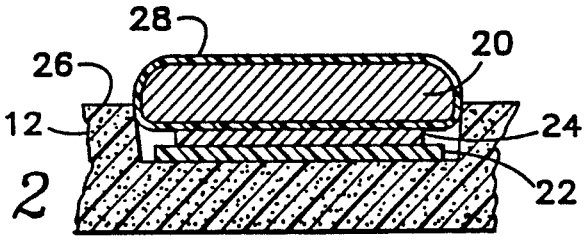
FIG. 2 is a partial cutaway view taken along line A—A of FIG. 1.
Figure 3:
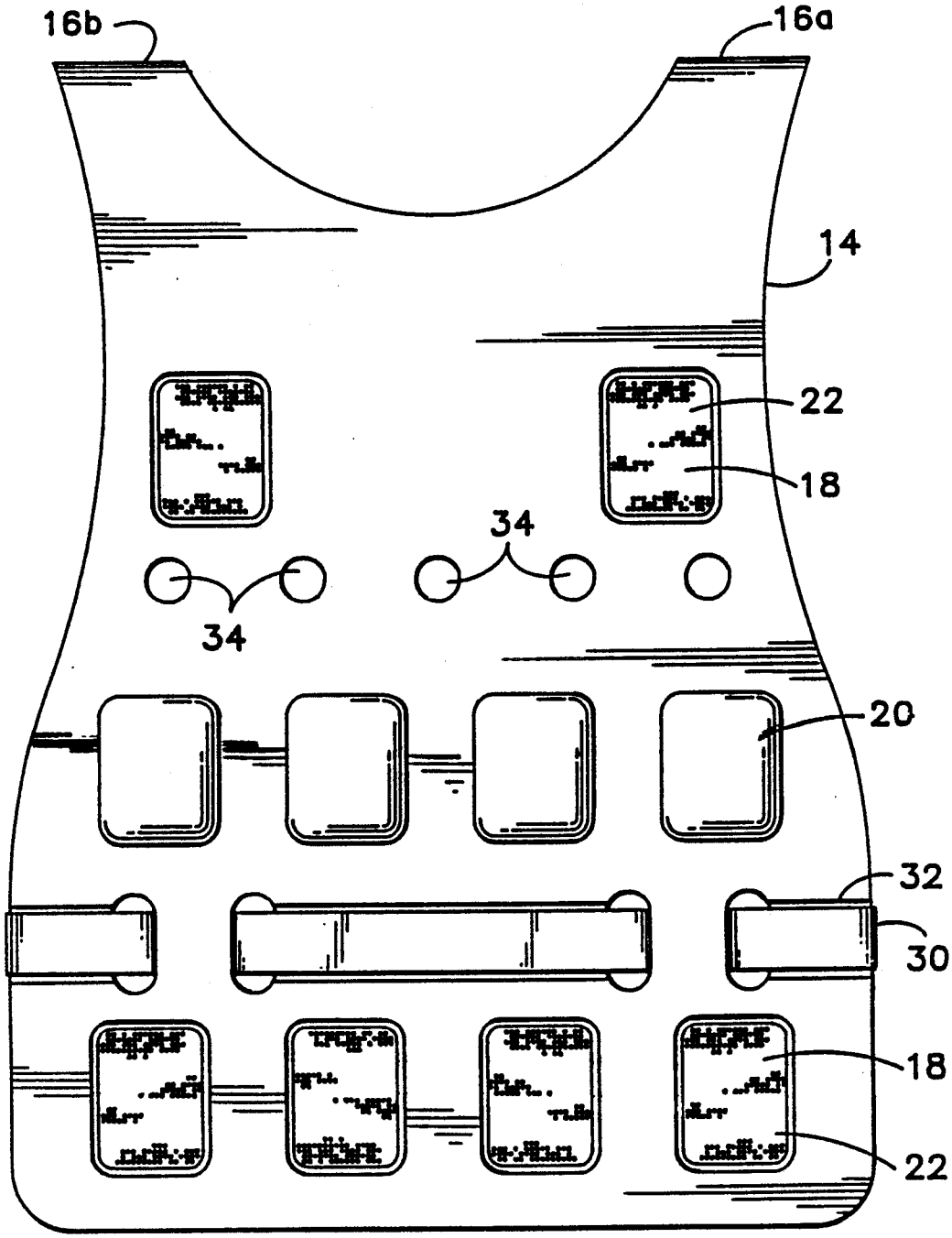
FIG. 3 is a back view of the athletic training vest device of FIG .1.
Figure 4:
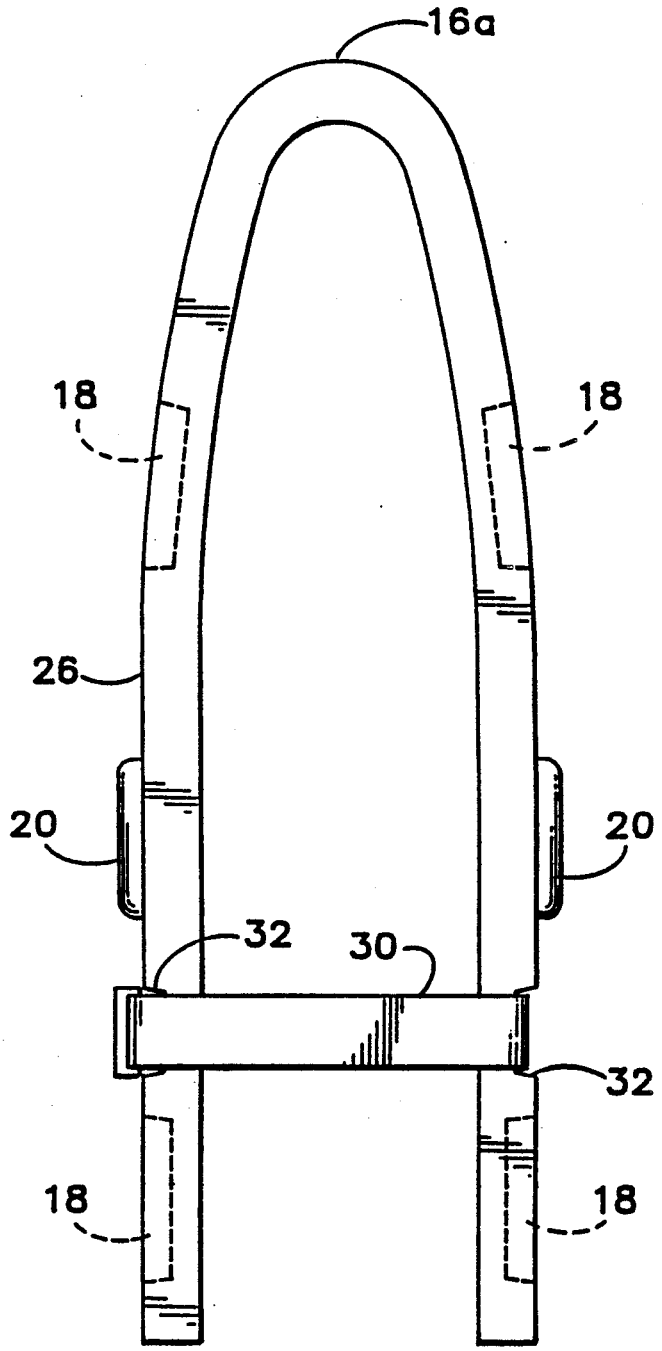
FIG. 4 is a side view of the athletic training vest device of FIG. 3.

An athletic training vest device 10 is shown in FIG. 1 being worn by an athlete. The vest 10 includes a front panel 12 and a rear panel 14 (refer to FIG. 3) joined by a pair of connecting portions 16*a* and 16*b* which extend across the wearer's shoulders. The vest 12 is formed from a single sheet of low density expanded closed cell ethylene-vinyl acetate (EVA),copolymer material. A suitable source of such material is marketed under the tradename BEVALITE available from Boyd Corporation of San Leandro, California. This material is bendable and resilient, yet has a high coefficient of friction against the skin. It may therefore be held snugly against an athlete's person without slipping. The vest 10 includes pocket-like recesses 18 which are adapted to receive correspondingly sized weights 20. The recesses include fastening material 22 which may comprise a matrix of connecting members adapted to cooperatively mate with complimentary connecting material 24 affixed to the underside of the weights 20. The fastening materials 22 and 24 may be any conventional pressure sensitive fastening material, a preferred form of which is marketed under the "Scotchmate" trademark as a dual lock fastening system by 3M Company of St. Paul, Minnesota. The dual lock fastening systems are similar to loop and pile fasteners but provide a better connection that is more rigid and better able to withstand the dynamic forces acting on the weights during a training session.

The weights 20 are made of a heavy metal such as lead and are beveled on all edges and corners so that there are no sharp protrusions from the surface of the vest material. Thus, the portions of the weights 20 that protrude past the plane 26 of the panel 12 are generally smoothed and rounded. To further ensure that the weights will not hinder an athlete's movements, they may be coated with a plastic or rubber material such as polyvinyl chloride (PVC) 28.

The recesses 18 are arranged in horizontally symmetric rows on the front and back panels 12 and 14, respectively, with the majority of the recesses being concentrated near the bottom of each panel adjacent the midsection area. Bisecting the two lowermost rows of weights is a belt 30 that lies within an elongate recess 32 formed in the front and rear panels 12 and 14. This arrangement concentrates the weights close to the center of mass of the body permitting the athlete to train dynamically in numerous different types of athletic activity without adversely affecting balance. Concentrating the weights in this region where they are bisected by a single beltline also serves to permit the heaviest portion of the training vest to be held snugly against the body. This permits twisting and bending upper body movements without interference from the weights as well as permitting increased chest cavity and back expansion and contraction. Both the front and rear panels 12 and 14 respectively include a series of vent holes 34 which permit the wearer's body to "breathe."

The weights 20 are selectively attached and removed from the recesses 18 by pressing the weights into the recesses to engage the fasteners and pulling the weights away to remove them. Placement of the appropriate weights depends on the type of activity that the athlete is engaged in and the amount of resistance (weight) desired.

The terms and expressions which have been employed in the foregoing abstract and specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. An athletic training vest device adapted to be worn upon an athlete's person while engaged in an athletic activity comprising:

(a) respective front and rear flexible panels adapted to fit against the wearer's back and chest respectively, said panels including a plurality of recessed areas forming pockets therein;

(b) interconnecting means extending between said front and rear panels;

(c) fastening material disposed in each of said recessed areas; and (d) a plurality of weights each having a shape to fit inside one of said recessed areas and including cooperatively mating coupling means for fastening said weights to said fastening material.

2. The athletic training vest device of claim 1 wherein said weights have a smooth surface and generally rounded edges extending from said recessed areas to provide a generally smooth surface for the outside of both front and rear panels.

3. The athletic training vest device of claim 1 wherein said recessed areas are arranged in a generally symmetrical horizontal pattern on each of said panels.

4. The athletic training vest device of claim 3 wherein a plurality of said recessed areas are arranged in two symmetric rows near the bottom of each panel adjacent the wearer's midsection, and said rows are bisected by an elongate recess to receive a belt for holding said front and rear panels snugly against the wearer's person in the hip area.

5. The athletic training vest device of claim 1 wherein both front and rear panels are formed from a low density copolymer material.

6. The athletic training vest device of claim 5 wherein both front and rear panels and said interconnecting means are formed from a single piece of low density copolymer material.

7. The athletic training vest device of claim 1 wherein at least one of said panels includes a plurality of venting holes.

8. The athletic training vest device of claim 1 wherein said fastening material is pressure sensitive.

9. The athletic training vest device of claim 8 wherein said fastening material comprises a matrix of connecting members and said cooperatively mating coupling means on said weights includes corresponding members for fastening to said matrix of connecting members.

10. The athletic training vest device of claim 2 wherein said weights are formed from a heavy metal and are coated with a plastic or rubber material.

11. An athletic training vest device adapted to be worn upon an athlete's person while engaged in an athletic activity comprising:

(a) respective front and rear flexible panels adapted to fit against the wearer's back and chest, respectively;

(b) interconnecting means extending between said front and rear panels;

(c) a plurality of weights having generally rounded edges and corners held to said panels in pocketlike recesses arranged in a symmetrical matrix, said matrix forming two horizontal rows near the bottom of each of said panels adjacent the wearer's mid-section; and (d) a single belt for holding said front and rear panels snugly against the wearer's mid-section, said belt extending around the torso between said horizontal rows of weights in each panel.

12. The training device of claim 11 wherein said pocket-like recesses include pressure sensitive fastening material and said weights include cooperatively mating means for affixing said weights to said fastening material in said pocket-like recesses.

13. The training vest device of claim 11 wherein said belt lies in an elongate recess formed in both front and rear panels.

14. The training vest device of claim 11 wherein at least one of said panels includes a set of venting holes.

* * * * *